US007311090B2

(12) United States Patent
Lyons

(10) Patent No.: US 7,311,090 B2
(45) Date of Patent: Dec. 25, 2007

(54) ENGINE EXHAUST GAS PASSAGE FLOW ORIFICE AND METHOD

(75) Inventor: Timothy M. Lyons, Batavia, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 18 days.

(21) Appl. No.: 11/343,983

(22) Filed: Jan. 31, 2006

(65) Prior Publication Data

US 2007/0175457 A1 Aug. 2, 2007

(51) Int. Cl.
*F02M 25/07* (2006.01)
*F02B 47/08* (2006.01)
*F02B 33/44* (2006.01)

(52) U.S. Cl. ..... 123/568.11; 123/568.12; 60/605.2

(58) Field of Classification Search ..... 123/568.1–568.13, 568.17, 568.2; 60/278, 60/605.2
See application file for complete search history.

(56) References Cited

U.S. PATENT DOCUMENTS 2,757,654 A * 8/1956 White ..... 123/568.11
3,965,749 A 6/1976 Hadden et al.
4,020,805 A 5/1977 Konomi et al.
4,069,797 A 1/1978 Nohira et al.
4,080,941 A 3/1978 Bertrand
4,143,635 A * 3/1979 Iizuka et al. ..... 123/568.11
5,224,819 A 7/1993 Kernon et al.
5,277,022 A 1/1994 Shekleton et al.
5,517,976 A * 5/1996 Bachle et al. ..... 123/568.11
5,802,846 A * 9/1998 Bailey ..... 60/278
5,894,726 A * 4/1999 Monnier ..... 123/568.11
6,062,027 A 5/2000 Landfahrer et al.
6,446,617 B2 9/2002 Bianchi et al.
6,470,864 B2 10/2002 Kim et al.
6,752,132 B2 * 6/2004 Remmels et al. ..... 123/568.11
2002/0005190 A1 * 1/2002 Bianchi ..... 123/568.12
2003/0178002 A1 9/2003 Israel et al.
2003/0230081 A1 12/2003 Waller

* cited by examiner

*Primary Examiner*—Willis R. Wolfe, Jr.
(74) *Attorney, Agent, or Firm*—Jeffrey P. Calfa; Gerald W. Askew

(57) ABSTRACT

An apparatus includes a gas passage (700) having a gas inlet (702), an engine gas outlet (704), and at least one exhaust gas recirculation (EGR) gas outlet (706), wherein the at least one EGR gas outlet (706) is disposed between the gas inlet (702) and the engine gas outlet (704). The gas passage (700) is arranged to receive exhaust gas through the inlet (702) and expel gas through both the gas outlets (704 and 706). A flow orifice (710) is operatively associated with the gas passage (700) and is disposed between the engine gas outlet (704) and the at least one EGR gas outlet (706).

13 Claims, 4 Drawing Sheets

FIG. 2
PRIOR ART
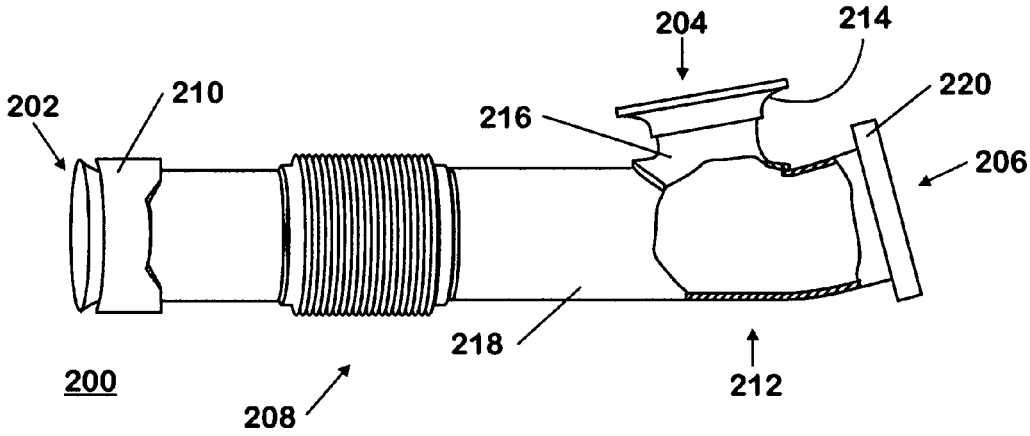
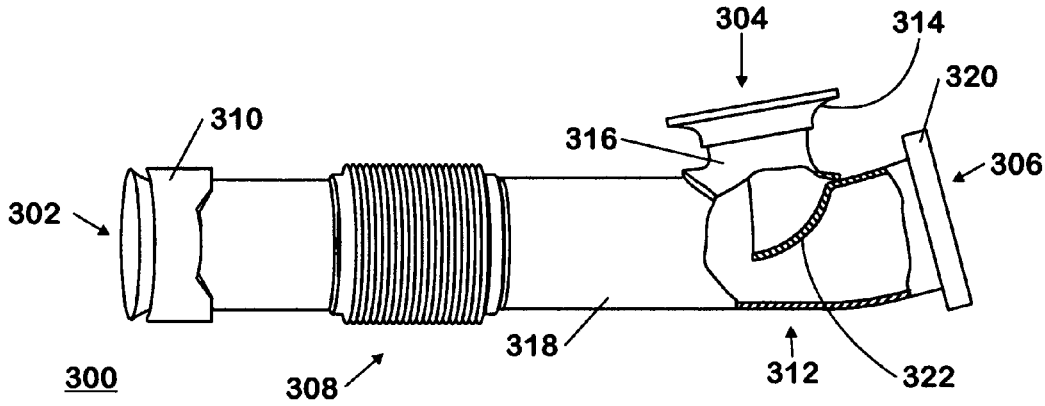
FIG. 3
PRIOR ART

ENGINE EXHAUST GAS PASSAGE FLOW ORIFICE AND METHOD

FIELD OF THE INVENTION

This invention relates to internal combustion engines, including but not limited to engines having exhaust gas recirculation passages.

BACKGROUND OF THE INVENTION

Exhaust gas recirculation (EGR) for internal combustion engines is known. Some engines may also cool the recirculated exhaust gas in EGR coolers. In an engine having a turbocharger, a difference in pressure between the exhaust system and intake system of the engine may determine the maximum amount of exhaust gas that may be recirculated from the exhaust into the intake of the engine.

The pressure of exhaust gas in the exhaust system during operation of the engine is referred to as exhaust back pressure (EBP). Similarly, the pressure of air or a mixture of air and exhaust gas in the intake manifold of the engine is referred to as intake manifold pressure or manifold absolute pressure (MAP) during operation of the engine. An EGR valve is usually employed to fluidly connect the exhaust and intake manifolds. When the EGR valve is opened, exhaust gas flows from the exhaust system into the intake system of the engine. Primary factors that determine the capacity of the EGR system on an engine to flow exhaust gas are the size of the EGR valve opening, and a difference of pressure between EBP and MAP, typically referred to as Delta P.

For emissions control reasons, some engines may require more EGR gas for mixing with the intake air than the engine is able to provide during operation, partly because many engines are advantageously designed to run under low Delta P conditions that are conducive to high fuel economy. Nevertheless, even under conditions of low Delta P, the demand for EGR gas flow increases as emissions requirements for the engine become more stringent.

There have been many methods to augment EGR gas flow on an engine having low Delta P during operation. One method uses an intake throttle valve, configured to constrict air flow into the intake manifold of an engine that is placed at a location upstream of the point of mixing of exhaust gas and air in the intake system. By closing the intake throttle valve, the MAP is lowered and Delta P increases. One disadvantage of this method is that pumping losses in the engine increase, thus lowering fuel economy and the power output of the engine.

Accordingly, there is a need for augmentation of EGR gas flow in an engine having a turbocharger that does not depend on the use of an intake throttle valve or other methods.

SUMMARY OF THE INVENTION

An apparatus includes a gas passage having a gas inlet, an engine gas outlet, and at least one exhaust gas recirculation (EGR) gas outlet, wherein the at least one EGR gas outlet is disposed between the gas inlet and the engine gas outlet. The gas passage is arranged to receive exhaust gas through the inlet and expel gas through both the gas outlets. A flow orifice is operatively associated with the gas passage and is disposed between the engine gas outlet and the at least one EGR gas outlet.

An internal combustion engine includes an intake system in fluid communication with a plurality of cylinders and an exhaust system in fluid communication with the plurality of cylinders. A turbocharger includes a turbine in fluid communication with the exhaust manifold and a compressor in fluid communication with the intake manifold. An exhaust gas recirculation (EGR) passage fluidly connects the exhaust system with the intake system, and contains an EGR valve. A gas passage fluidly connects the exhaust system with the turbine and the EGR passage. An orifice is located in the gas passage, between the EGR passage and the turbine.

A method for augmenting flow out of a gas passage includes the step of collecting exhaust gas in a volume of an internal combustion engine. Exhaust gas flows out of the volume to form an exhaust gas flow into a junction. A first portion of the exhaust gas flow exiting the junction is constricted with an orifice. The first portion of the exhaust gas flow is routed to a turbine and a second portion of the exhaust flow exiting the junction is routed to an exhaust gas recirculation (EGR) cooler.

BRIEF DESCRIPTION OF THE DRAWINGS

FIGS. 2 and 3 are perspective views in partial cut-away of prior art exhaust system pipes.

DESCRIPTION OF A PREFERRED EMBODIMENT

Figure 1:
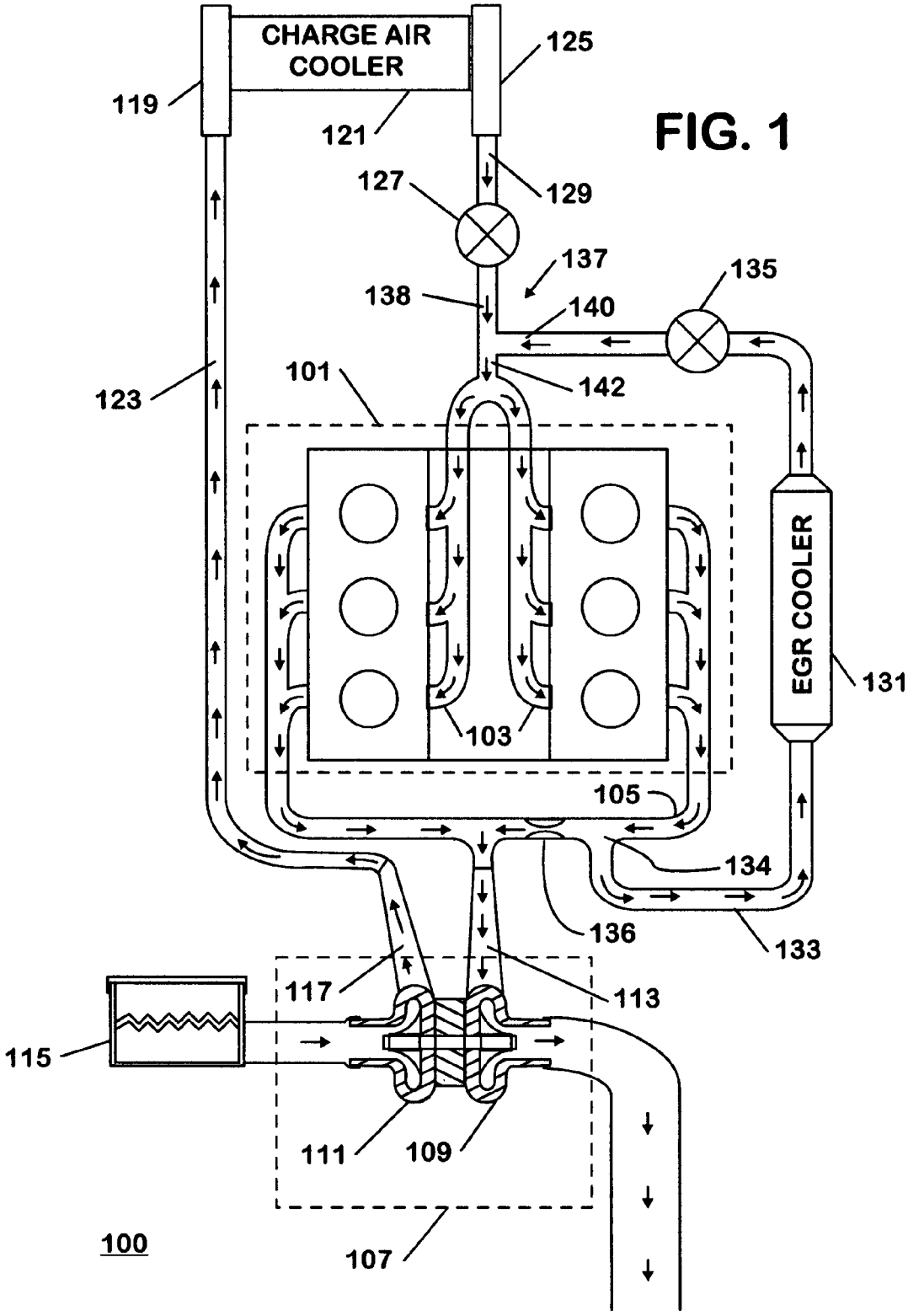
FIG. 1 is a schematic diagram of an engine having a gas passage flow orifice in accordance with the invention.

The following describes an apparatus for and method of augmenting flow of exhaust gas from an exhaust system of a turbocharged diesel engine into an EGR cooler without creating additional restriction in an intake system of the engine. The diesel engine may have an intake throttle device, and may additionally have one or more turbochargers. A typical diesel engine 100 is shown in FIG. 1.

The engine 100 has a crankcase 101 that includes a plurality of cylinders in the crankcase 101 that are fluidly connected to an intake system 103 and to an exhaust system 105. A turbocharger 107 includes a turbine 109 having a turbine inlet 113 connected to the exhaust system 105 and driving a compressor 111 connected to the intake system 103. An air cleaner 115 is connected to an inlet of the compressor 111. An outlet 117 of the compressor 111 is connected to an inlet 119 of a charge air cooler 121 through a hot air passage 123. An outlet 125 of the charge air cooler 121 is connected to an intake throttle 127 through a cold air passage 129.

An EGR cooler 131 is connected to the exhaust system 105 through an EGR passage 133 at a Y-junction 134. Downstream of the EGR cooler 131 is an EGR valve 135. The EGR valve 135 may alternatively be connected upstream of the EGR cooler 131 in the EGR passage 133, but still downstream of the junction 134. On an outlet side of the EGR valve 135 is a mixing junction 137 having a first inlet 138 connected to the intake throttle 127 and a second inlet 140 connected to the EGR valve 135. An outlet 142 of the mixing junction 137 is connected to the intake system 103. During normal engine operation, cooled intake air enters the mixing junction 137 through the first inlet 138 and mixes with exhaust gas entering the junction 137 from the second inlet 140. A mixture of exhaust gas and air exits the junction 137 from the outlet 142 and enters the intake system 103.

When the engine 100 operates at or near an idle condition, i.e., when engine speed is low and there is little to no torque load on the engine, the intake throttle may be completely closed 127 while the EGR valve 135 may be open to induce a flow of exhaust gas from the junction 134 to enter the EGR passage 133, pass through the EGR cooler 131, the EGR valve 135, and enter the junction 137. The mixture of air and exhaust gas exiting the junction 137 must be adequate to maintain a stable idle engine speed of the engine 100.

When the engine 100 operates above an idle condition, the intake throttle 127 may be substantially, or more than 5%, open. Cooled intake air exiting the charge air cooler 121 enters the junction 137 and mixes with exhaust gas coming from the EGR valve 135. The mixture of air and exhaust gas exits the junction 137 and enters the intake system 103 of the engine 100. A desired flow of exhaust gas from the EGR valve 135 may be augmented by, for example, constricting fresh air flow into the engine 100 by closing the intake throttle 127 to an adequate extent. This solution to inducing exhaust gas flow through the engine 100 creates losses in engine efficiency. For example, an increase in intake restriction of the engine causes a loss of power and increased fuel consumption. In a first embodiment of the invention, a flow orifice 136 is added downstream of the junction 134 in the exhaust system 105. The flow orifice 136 causes a high pressure region of exhaust gas to be created adjacent to and upstream of the orifice 136. This high pressure region forces exhaust gas to enter the passage 133.

In the prior art, many different arrangements have been used to augment flow of exhaust gas in an EGR system of an engine. An example of a typical exhaust system pipe 200 is shown in FIG. 2 and has an inlet 202, an EGR outlet 204, and an exhaust outlet 206. The exhaust system pipe 200 has a bellows section 208 between an inlet flange 210 and a Y-section 212 that aids in taking up stresses due to misalignment or thermal growth of the exhaust system pipe 200 as installed and operated on an engine. The EGR outlet 204 may have a flange 214 that is adapted for an engine component allowing for fluid communication to an EGR cooler (not shown). The flange 214 is part of a saddle 216 that is typically welded onto a main tube 218 to form a Y-section 212. An outlet flange 220 allows connection of the exhaust outlet 206 to the engine.

Use of an exhaust system pipe 200 alone does not enable adequate inducement of exhaust gas to pass from the main pipe 218 into the EGR outlet 204. A known feature to aid exhaust gas flow through an EGR outlet 304 of an exhaust system pipe 300 is shown in FIG. 3. The exhaust system pipe 300 has an inlet 302, the EGR outlet 304, an exhaust outlet 306, and a bellows section 308 between an inlet flange 310 and a Y-section 312. An outlet flange 320 allows connection to the engine. The EGR outlet 304 may have a flange 314 that is adapted for an engine component allowing for fluid communication to an EGR cooler (not shown). The flange 314 is part of a saddle 316 that is typically welded onto a main tube 318 to form the Y-section 312. A "scoop" 322 is formed in the Y-section 312 to deflect exhaust flow coming from the inlet 302 to enter the EGR outlet 304. However, manufacturing and assembly processes for the scoop 322 are costly and complex.

Figure 4:
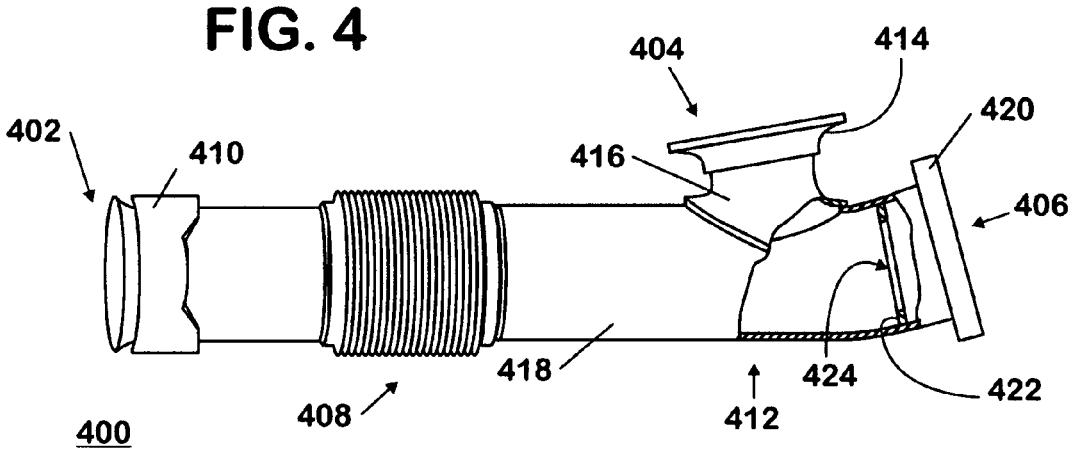
FIG. 4 is a partial cut-away of an exhaust system pipe incorporating the flow orifice of FIG. 1 in accordance with the invention.

Computational simulations of exhaust flow through an exhaust system pipe have indicated that an improvement in the complexity of the design for the exhaust system pipe may be made without compromising performance. One embodiment of an improved exhaust system pipe 400 is shown in FIG. 4. Similar to the previous embodiments, the exhaust system pipe 400 has an inlet 402, an EGR outlet 404, an exhaust outlet 406, and a bellows section 408 between an inlet flange 410 and a Y-section 412. An outlet flange 420 allows connection of the exhaust outlet 406 to the engine. The EGR outlet 404 may have a flange 414 that is adapted for an engine component allowing for fluid communication to an EGR cooler (not shown). The flange 414 is part of a saddle 416 that is typically welded onto a main tube 418 to form the Y-section 412. In accordance with the invention, an orifice plate 422 is located inside the main tube 418, downstream of the intersection 412 to restrict exhaust flow coming from the inlet 402 from entering outlet 406 and thereby force a quantity of exhaust gas to turn into and through the EGR outlet 404.

The orifice plate 422 may be made of steel sheet metal, and may advantageously be welded into the tube 418 before the flange 420 is installed thereon. The orifice plate 422 has an opening 424 to allow exhaust gas to pass through and exit through the exhaust outlet 406. The opening 424 may be circular, or it may be another appropriate shape for the size and type of the tube 418, for example, the opening 424 may be elliptical if installed in an area of the tube 418 that is also elliptical. A size for the opening 424 may be determined based on computational calculations, depending on the requirements of the engine as well as the sizes of the openings in the EGR outlet 404, the exhaust opening 406, and the inlet opening 402. The size of the opening 424 may advantageously provide a flow area that is about 40% less than the flow area provided by the tube 418 prior to the orifice plate 422, but other reductions in area may be used.

Figure 5:
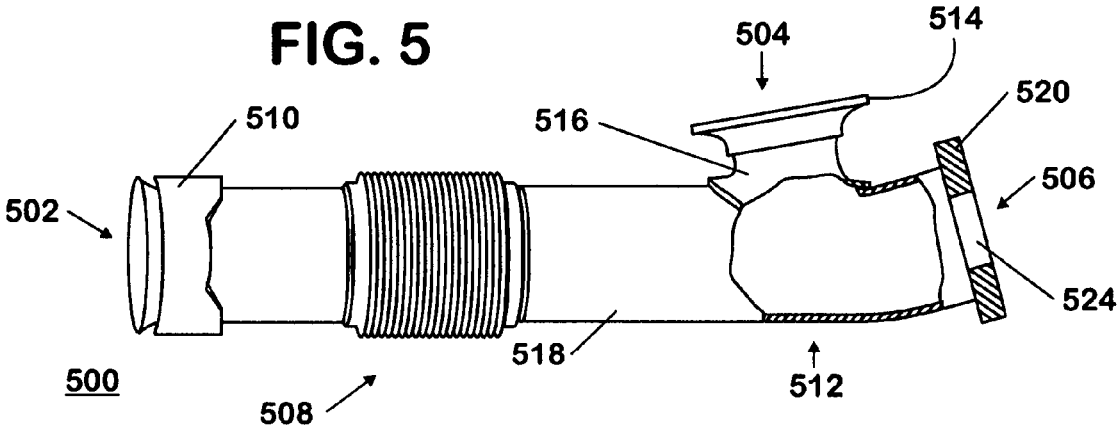
FIG. 5 is a partial cut-away of an exhaust system pipe having an orifice opening in a flange in accordance with the invention.

An alternative embodiment of an exhaust system pipe 500 is shown in FIG. 5 and has an inlet 502, an EGR outlet 504, an exhaust outlet 506, and a bellows section 508 between an inlet flange 510 and a Y-section 512. An outlet flange 520 allows connection to the engine. The EGR outlet 504 may have a flange 514 that is adapted for an engine component allowing for fluid communication to an EGR cooler (not shown). The flange 514 is part of a saddle 516 that is typically welded onto a main tube 518 to form the Y-section 512.

The outlet flange 522 has an opening 524 to allow exhaust gas to pass through and exit the exhaust outlet 506. The opening 524 is smaller than the size of the tube 418 and may be circular, or another appropriate shape for the size and type of the tube 518. For example, the opening 524 may be elliptical if installed in an area of the tube 518 that is also elliptical. Similar to the exhaust system 400, the size of the opening 524 may advantageously provide a flow area that is about 40% less than a flow area provided by the tube 518, but other sizes may be used.

Figure 6:
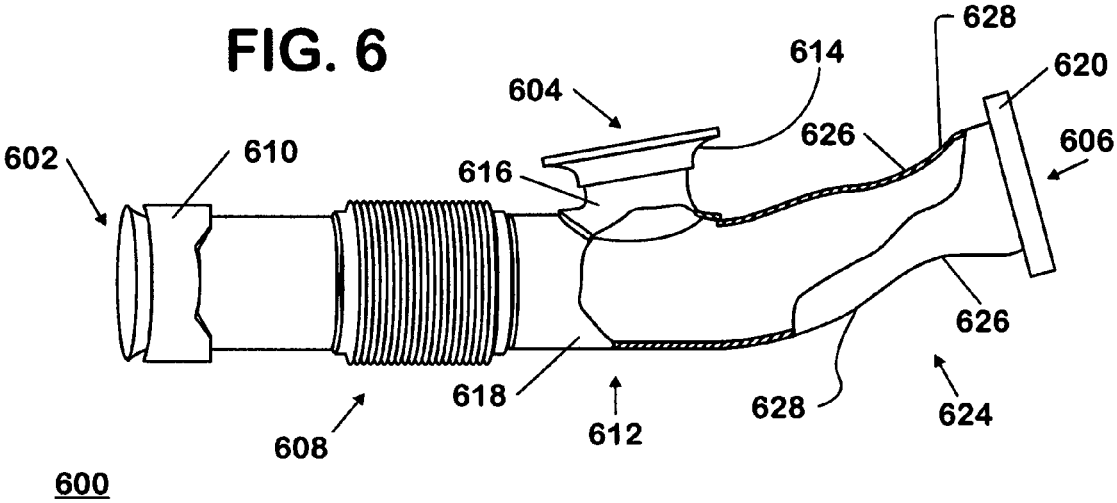
FIG. 6 is a partial cut-away of an exhaust system pipe having a constriction in accordance with the invention.

Another alternative embodiment of an exhaust system pipe 600 that has an inlet 602, an EGR outlet 604, an exhaust outlet 606, and a bellows section 608 disposed between an inlet flange 610 and a Y-section 612 is shown in FIG. 6. An outlet flange 620 allows connection to the engine. The EGR outlet 604 may have a flange 614 that is adapted to allow fluid communication to an EGR cooler (not shown). The flange 614 is part of a saddle 616 that is typically welded onto a main tube 618 to form the Y-section 612.

The tube 618 has a constrictor section 624 at a location between the Y-section 612 and the exhaust outlet 606. A smallest internal diameter of the constrictor section 624 is smaller than an internal diameter of the tube 618. The constrictor section 624 may be formed by a radially inward loading applied to a section of the tube 618 causing plastic deformation of the section to the tube 618. The constrictor 624 may have an orifice section 626 positioned between two blending sections 628. The blending sections 628 may be the result of a pressing operation to form the constrictor 624, and may also help relieve stresses during thermal gradients of the Y-pipe 600 during operation. The constrictor orifice section 626 may advantageously provide a flow area that is about 40% less than a flow area provided by the tube 618, but other reductions in flow area may be used.

Figure 7:
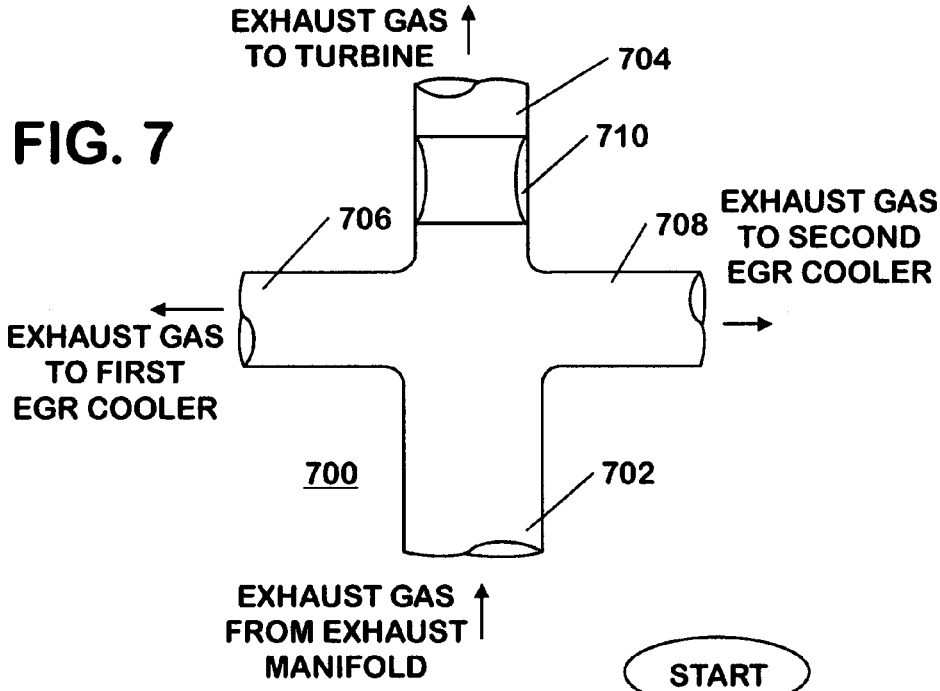
FIG. 7 is a schematic diagram of a fluid junction having a gas passage flow orifice in accordance with the invention.

Use of an orifice can advantageously augment flow for more than one outlets of a fluid junction. A fluid junction 700 is shown in FIG. 7. The fluid junction 700 has a main inlet 702, a primary outlet 704, and two secondary outlets 706 and 708. The main inlet 702 is in fluid communication with the outlets 704, 706, and 708. A fluid flow enters the junction 700 through the main inlet 702. A majority of the fluid flow may exit the junction 700 through the primary outlet 704. An orifice 710 is positioned in the junction 700, downstream of the secondary outlets 706 and 708, and upstream of the primary outlet 704. During operation, the orifice 710 may constrict fluid flow out of the primary outlet 704 and force fluid to flow through the secondary outlets 706 and 708.

The junction 700 may be advantageous for the operation of an engine having more than one EGR cooler connected to an exhaust system, each cooler receiving exhaust gas from one of the secondary outlets 706 and 708. A fluid flow exiting the primary outlet 704 may be exhaust gas routed to a turbocharger turbine. Fluid flowing out of the secondary outlet 706 may be exhaust gas routed to a first EGR cooler (not shown), while fluid flowing out of the secondary outlet 708 may be exhaust gas routed to a second EGR cooler (not shown). The junction 700 may be integrated with exhaust pipes in the engine's exhaust system, and may be fabricated from steel sheet or any other appropriate material or process known in the art of engine exhaust systems.

Figure 8:
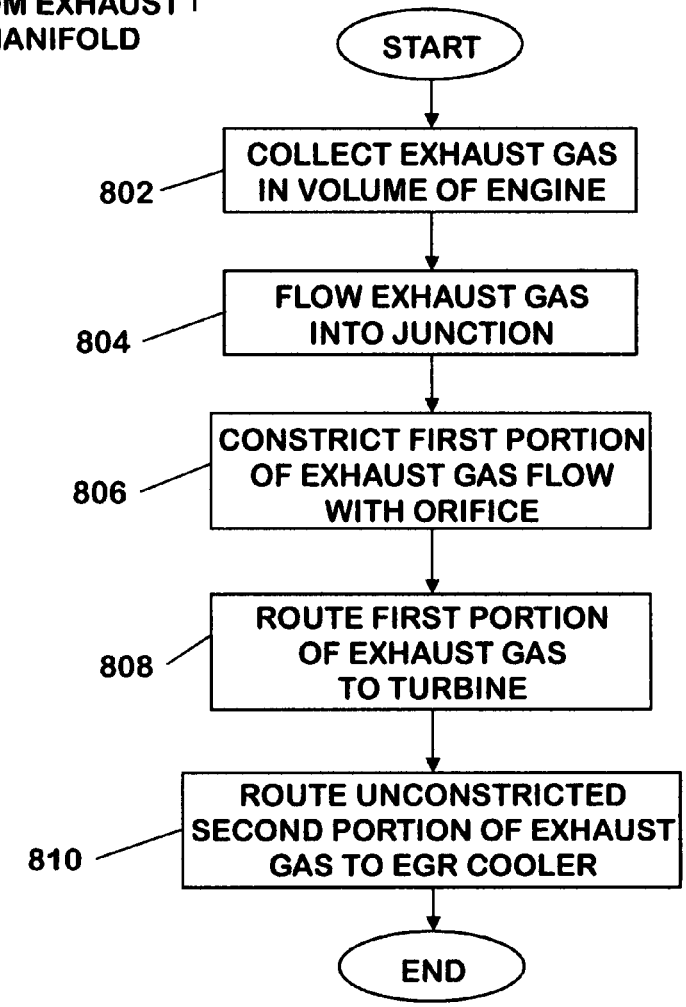
FIG. 8 is a flowchart for a method of constricting flow in a gas passage with an orifice in accordance with the invention.

A method for augmenting flow of exhaust gas through an outlet of an exhaust system pipe in an internal combustion engine is shown in FIG. 8. A quantity of exhaust gas is collected in a volume of an internal combustion engine at step 802. A flow of exhaust gas exits the volume and enters a fluid junction through an inlet at step 804 to be routed to a turbocharger and at least one EGR cooler. A flow orifice constricts a first portion of the exhaust flow in step 806. The first portion of the exhaust gas flow exits out of the fluid junction through an exhaust outlet at step 808 from where it is routed to a turbine. A second portion of the flow exits the fluid junction through an EGR outlet at step 810, augmented by an orifice placed close to the exhaust outlet, downstream of the EGR outlet. The process may be repeated while the internal combustion engine is in operation and gas is free to flow through the EGR outlet.

The method may be repeated during operation of the engine. In a case where one EGR cooler is used, the fluid junction may be a Y-pipe. If two EGR coolers are used, the fluid junction may be replaced by a cross-junction. The fluid junction may be arranged in any configuration that enables supply of exhaust gas to as many EGR coolers as necessary. In any case, the orifice may be placed on a leg of the junction that is connected to an inlet of a turbine to augment exhaust gas flow going to the EGR coolers that may be connected to other legs of the junction.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method for augmenting flow out of a gas passage, comprising the steps of:

collecting exhaust gas in a volume of an internal combustion engine;

flowing the exhaust gas out of the volume to form an exhaust gas flow into a junction;

constricting a first portion of the exhaust gas flow exiting the junction with a fixed flow area orifice;

routing the first portion of the exhaust gas flow to a turbine; and routing an unconstricted second portion of the exhaust flow exiting the junction to an EGR cooler, wherein a high pressure region of exhaust gas is created adjacent to the orifice.

2. The method of claim 1, further comprising the step of routing a third portion of the exhaust flow exiting the junction to a second EGR cooler.

3. An engine exhaust system comprising:

an exhaust gas passage having an inlet through which exhaust gas from engine combustion chambers enters the passage, a first outlet through which exhaust gas is conveyed out of the passage toward a turbine of a turbocharger and a second outlet through which exhaust gas is conveyed out of the passage back toward the combustion chambers for recirculation, wherein a segment of the passage extends between the two outlets and comprises a fixed flow area orifice that is small enough to restrict flow to the first outlet and elevate the pressure in the passage at the second outlet from what that pressure would otherwise be in the absence of the orifice.

4. An engine exhaust system as set forth in claim 3, wherein orifice is formed by an indentation in a wall of the segment of the passage.

5. An engine exhaust system as set forth in claim 3, wherein the segment comprises one leg of a Y-pipe.

6. An engine exhaust system as set forth in claim 3, wherein the orifice comprises an opening in a flat plate disposed in the segment of the passage.

7. An engine exhaust system as set forth in claim 6, wherein the flat plate is disposed at a flange at an outlet end of the segment of the passage.

8. In a turbocharged internal combustion engine having an intake system leading to engine cylinders, and an exhaust system for conveying exhaust gas from the cylinders, including an exhaust manifold and a turbine in fluid communication with the exhaust manifold, and an exhaust gas recirculation (EGR) passage that shunts some of the exhaust gas coming from the cylinders away from the turbine and back to the intake system when an EGR valve in the EGR passage allows EGR flow, the improvement comprising:

a main passage comprising a fixed flow area orifice disposed therein downstream of where the EGR passage begins to shunt exhaust gas away from the turbine, the fixed flow area of the orifice being small enough to restrict flow to the turbine and elevate the pressure at which exhaust gas is shunted into the EGR passage from what that pressure would otherwise be in the absence of the orifice.

9. The improvement set forth in claim 8, further comprising an EGR cooler disposed in the EGR passage.

10. The improvement set forth in claim 8, further comprising a throttle disposed in the intake system.

11. The improvement set forth in claim 8, wherein the main passage comprises two of three legs of a Y-pipe, a first leg having a gas inlet communicated to the exhaust manifold, a second leg having an engine gas outlet communicated to the turbine, and a third leg being the beginning of the EGR passage, wherein the orifice is disposed in the first leg of the Y-pipe.

12. The improvement set forth in claim 11, wherein the orifice is formed by an indentation in a wall of a thin wall steel tube that forms the second leg of the Y-pipe.

13. The improvement set forth in claim 11, wherein the orifice comprises an opening in a flat plate disposed in the Y-pipe.

* * * * *